US005841738A

United States Patent [19]

Kamei et al.

[11] Patent Number: 5,841,738

[45] Date of Patent: Nov. 24, 1998

[54] DISPLAY UNIT STRUCTURE FOR ELECTRONIC DEVICE

[75] Inventors: Yuichi Kamei; Yasuo Kamiyama; Masao Mafune; Yoshio Katsuki, all of Tanashi, Japan

[73] Assignee: Citizen Watch Co., Ltd., Tokyo, Japan

[21] Appl. No.: 860,858

[22] PCT Filed: Nov. 12, 1996

[86] PCT No.: PCT/JP96/03317

§ 371 Date: Jul. 14, 1997

§ 102(e) Date: Jul. 14, 1997

[87] PCT Pub. No.: WO97/18500

PCT Pub. Date: May 22, 1997

[30] Foreign Application Priority Data

Nov. 14, 1995 [JP] Japan ..... 7-295139
Apr. 26, 1996 [JP] Japan ..... 8-107021

[51] Int. Cl.[6] ..... G04B 1/00; G04B 19/00; G04C 3/00

[52] U.S. Cl. ..... 368/205; 368/223

[58] Field of Search ..... 368/82–84, 223, 368/239–241

[56] References Cited

U.S. PATENT DOCUMENTS 4,834,475 5/1989 Robinson ..... 368/79
5,586,089 12/1996 McGarvey ..... 368/223

FOREIGN PATENT DOCUMENTS 62-165590 10/1987 Japan .
63-24678 2/1988 Japan .
5-85784 4/1993 Japan .
5-333758 12/1993 Japan .

*Primary Examiner*—Vit W. Miska
*Attorney, Agent, or Firm*—Kanesaka & Takeuchi

[57] ABSTRACT

A display unit structure for an electronic device is formed of a solar cell, and a display unit. The display unit includes a transparent base layer disposed on the solar cell, and a hologram layer laminated on the base layer and having a virtual mirror plane for reflecting a light with a predetermined wavelength. The virtual mirror plane of the hologram layer is inclined with respect to front and back surfaces of the hologram layer. Thus, the light with the predetermined wavelength is reflected by the hologram layer, and light other that the predetermined wavelength is transmitted to the solar cell.

10 Claims, 5 Drawing Sheets

DISPLAY UNIT STRUCTURE FOR ELECTRONIC DEVICE

FIELD OF THE INVENTION

This invention relates to a display unit structure for an electronic device having a display unit which reflects a light having a predetermined wavelength and transmits lights other than the light having the predetermined wavelength.

DESCRIPTION OF THE BACKGROUND ART

Recently, a solar battery has been significantly improved in technologies and been widely used for various electronic devices as the light source for electronic watches, electronic calculators, portable radios, and the like.

As such a solar battery, an amorphous solar battery produced by applying amorphous silicon to a glass substrate or a metal substrate is generally used.

There is a case of using a solar battery of this type in a display unit structure for an electronic watch as shown in FIGS. 9 and 10.

As shown in FIGS. 9 and 10, this display unit has a structure in which four solar cells 2 of a planar fan shape are disposed in parallel on the periphery and over a movement 1, and are electrically connected in series an insulating band 3 is interposed between the solar cells 2, a transparent plane 4 formed from a polycarbonate or acryl resin is laminated on the insulating band 3 and solar cells 2, and a commercial name, characters 5 for displaying time, and the like are displayed on the transparent plane 4 by printing or the like. Incidentally, it is important that electronic watches provided with the display unit structure of this type not only have excellent functions but also exhibit an excellent appearance.

However, in conventional display unit structures for electronic watches, the solar cells 2 have a dark brown or dark blue color so that the watch display is viewed as if it has a dark brown or dark blue color. Also, since the insulating band 3 is interposed between the solar cells 2, it is viewed as a material with a planar cross shape. There are substantial limitations to the design including the color tone of the watches and the product quality is also degraded.

There is a display unit structure for an electronic device disclosed in Japanese Patent Publication No. 38464/1993 to solve the above problems.

This display unit structure for an electronic device comprises a solar battery for supplying power to a movement for driving a device, a color filter capable of transmitting a light of a wavelength contributing to power generation of the solar battery, and a scattering layer made of a white scattering plate which transmits part of the light from the color filter and scatters the remainder in all directions.

Here, the scattering layer is, for example, made of an acrylic opaque plate, produced by applying a delustering clear lacquer on a half mirror, or produced by roughing one of the surfaces, the other surface being laminated with aluminum to form a mirror.

However, in these display unit structures for electronic devices, the former scattering layer is seen as a darkish white because it must partially transmit light, whereby, for example, a metallic color which exhibits a high-class appearance cannot be provided. On the other hand, in the latter scattering layer, the light transmission varies and a color shade occurs due to uneven layer thickness. As a result, the display unit cannot be provided with the desired color tone, causing the problem that the degree of freedom in designing the appearance decreases.

In addition, in the conventional display unit structures for electronic devices a light having a predetermined wavelength is scattered in all directions. When an observer views a display unit, the scattered light can be viewed not only from a specific direction along the usual line of sight but also from all the directions. The transmittable light transferred to a solar battery is reduced and hence the utilization efficiency of the light is reduced.

Accordingly, the present invention has been achieved in view of this situation and has an object of providing a display unit structure in which a display device includes a hologram layer provided with a virtual mirror plane for reflecting a light having a predetermined wavelength and the virtual mirror plane of the hologram layer is located in a position which allows the virtual mirror plane of the hologram layer to be inclined to the front and back surfaces of the hologram layer, thereby improving the degree of freedom in designing the appearance and also improving the light utilization factor.

DISCLOSURE OF THE INVENTION

The above object can be attained in the present invention by the provision of a display unit structure for an electronic device comprising a display unit including a hologram layer provided with a virtual mirror plane for reflecting a light having a predetermined wavelength, with the virtual mirror plane of the hologram layer located in a position which allows the virtual mirror plane of the hologram layer to be inclined to the front and back surfaces of the hologram layer.

By these measures, when an observer arranges the line of sight on the path of the light having a predetermined wavelength reflected on the virtual mirror plane of the hologram layer, the light having the predetermined wavelength reaches the observer, whereas lights of wavelengths other than the specific length penetrates the hologram layer.

DETAILED DESCRIPTION OF THE INVENTION AND PREFERRED EMBODIMENTS

The present invention will now be explained in detail.

Figure 1:
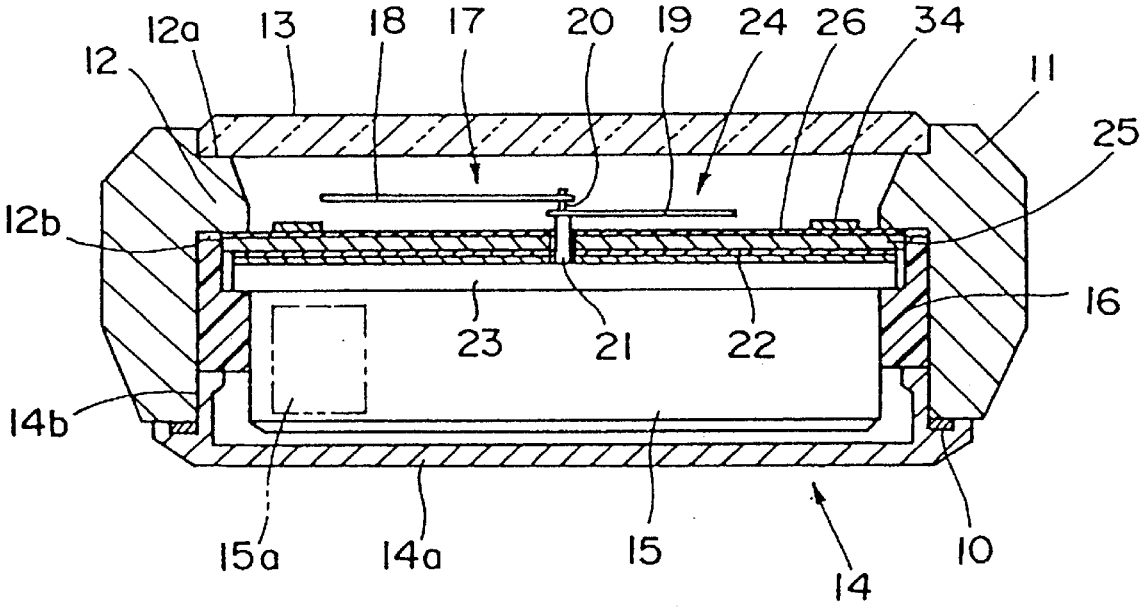
FIG. 1 is a vertical sectional view of a main portion of an internal mechanism of a wrist watch provided with a display unit structure for an electronic device corresponding to a first embodiment, in which the internal structure of the movement and the like are omitted.
Figure 2:
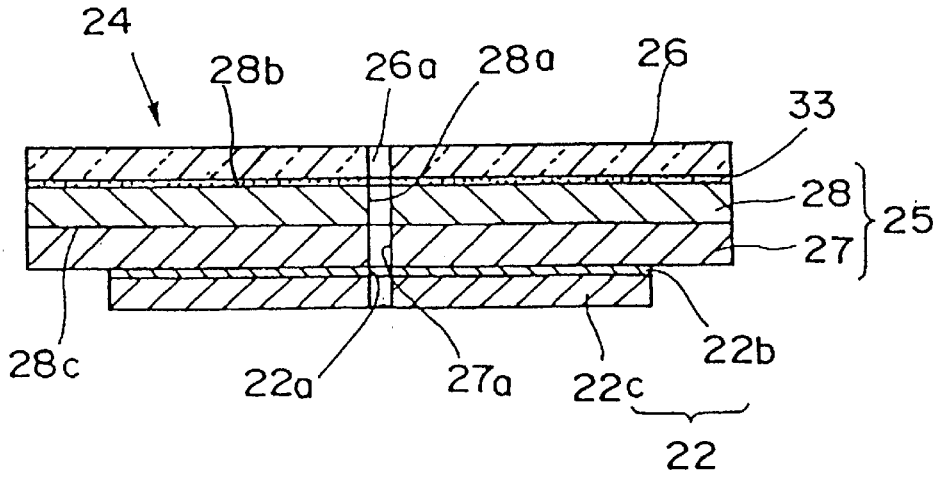
FIG. 2 is a vertical sectional view of the display unit structure of the electronic device corresponding to the first embodiment.
Figure 3:
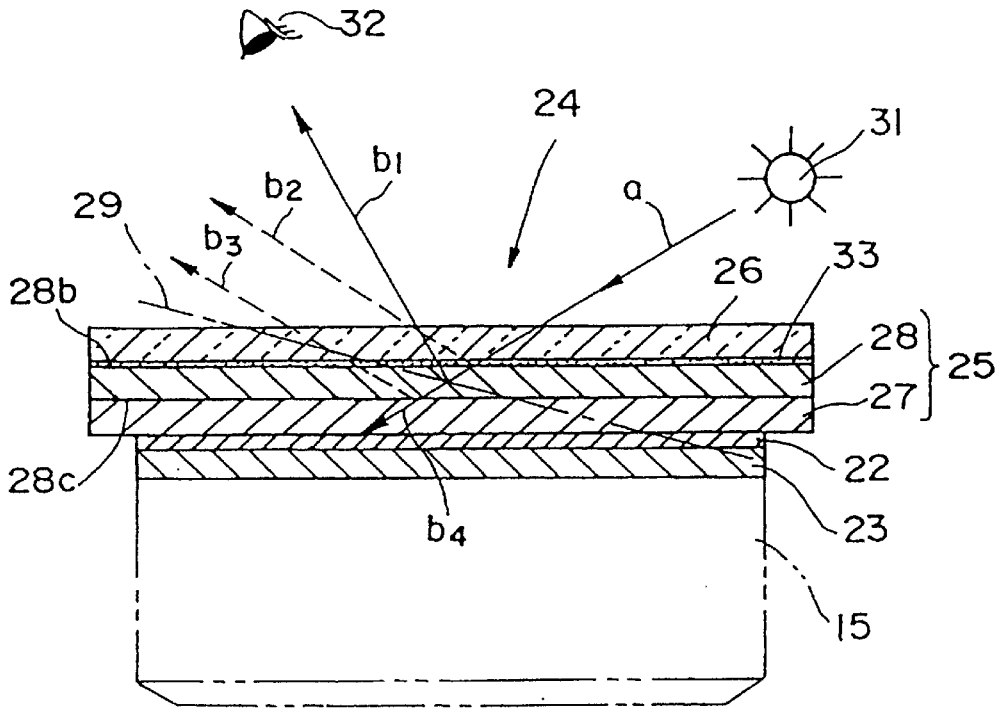
FIG. 3 is a vertical sectional view for explaining incident lights, reflecting lights, and transmitting lights relating to the display unit structure for the electronic device corresponding to the first embodiment.

FIG. 1 is a vertical sectional view of a main portion of an internal mechanism of a wrist watch provided with a display unit structure for the electronic device corresponding to a first embodiment, FIG. 2 is a vertical sectional view of the display unit structure for the electronic device corresponding to the first embodiment, and FIG. 3 is a vertical sectional view for explaining incident lights, reflecting lights, and transmitting lights relating to the display unit structure for the electronic device corresponding to the first embodiment.

In these figures, the symbol 11 represents a case band/case body made of a metal or a synthetic resin, which is formed entirely from a cylindrical material with both ends open. An internal flange 12 having flange ends 12*a*, 12*b* and projecting in the radial direction of the case band/case body is integrated with the internal peripheral surface close to one of the openings (the upper opening in the Figures) of the case band/case body 11.

The symbol 13 represents a glass made of glass or a synthetic resin and formed entirely from a transparent material of a circular shape in section. The glass 13 is installed inside the openings of the case band/case body so that its periphery is connected to the flange end 12*a*.

The symbol 14 represents a case back made of a metal or a synthetic resin. The case back 14 is made of a non-transparent material and has a lid body 14*a* facing the other of the openings (the lower opening in the Figures) of the case band/case body 11 and an engaging part 14*b* facing the inside of the other opening of the case band/case body 11. The case back 14 is installed in the other opening of the case band/case body 11 via a case back packing 10.

The symbol 15 represents a movement for rotating the hands. The movement 15 consists of a step motor 15*a*, a decelerating train wheel (not shown), and the like and is held in the case band/case body 11 via a casing ring/casing frame 16.

The symbol 17 represents a hand display unit for analogously indicating time. The hand display unit 17 includes a minute hand 18 and an hour hand 19 which are a hour hand and a minute hand respectively. The hand display unit 17 also includes a center wheel & pinion 20 and an hour wheel & pinion 21 which are respectively drive shafts for the minute hand 18 and the hour hand 19. The hands 18, 19 are rotated by driving the movement 15 to indicate time variably.

The symbol 22 represents a solar cell for supplying power to the step motor 15*a* for driving the movement. This solar cell 22 comprises a metal plate 22*c* formed of an SUS material or the like and an amorphous silicon layer 22*b* formed on the metal plate 22*c* by vapor deposition or the like. The solar cell 22 is disposed between the flange end 12*b* of the inside flange 12 and the movement 15 and is connected to the movement 15 through a circuit substrate 23. In the center of the solar cell 22, a shaft insertion hole 22*a* is provided by opening both upward and down ward (in the axial direction of the wheels & pinions 20, 21). Electric power generated in the solar cell is stored in a secondary battery or in a condenser (neither are shown) for a while.

The symbol 24 represents a display mechanism including the hand display unit 17. The display mechanism 24 also includes a transmission-type reflecting plate 25 and a coating layer 26 and disposed at the side opposite to the movement on the solar cell 22.

The transmission-type reflecting plate 25 is composed of a base layer 27 provided with a shaft insertion hole 27*a* communicating with the shaft insertion hole 22*a* in the center thereof and a hologram layer 28 provided with a shaft insertion hole 28*a* communicating with the shaft insertion hole 27*a* of the base layer 27. The transmission-type reflecting plate 25 is disposed at the side of the solar cell on the inner flange 12.

The base layer 27 is placed at the side opposite to the movement on the solar cell 22 and is formed entirely from a transparent material made of a synthetic resin such as polyester or polyethylene terephthalate. By these structures, the incorporation of the transmission-type reflecting plate 25 into the display mechanism 24 and the handling of the solar cell 22 can be simply performed.

The hologram layer 28 is formed of a volume type hologram (Lippman type hologram) and is laminated on the base layer 27 at the side of the hands. This hologram layer 28 is positioned at an inclination with respect to the surface 28*b* and back face 28*c* of the hologram layer. Also, the hologram layer 28 includes a virtual mirror plane 29 which, as shown in FIG. 3, receives incident lights a and reflects only a light b1 having a predetermined wavelength in a specific direction.

Specifically, the hologram layer 28 has characteristics dependent on the wavelength and on the angle of reflection. Because of this, among the incident lights a from a light source 31, only the light b1 having a predetermined wavelength is reflected on the virtual mirror plane 29 in a specific direction which never coincides with the directions of the paths of surface reflecting lights b2 and b3 which are each shown as a dotted line in FIG. 3 and reach an observer 32. Also, the hologram layer 28 has light transmittability and hence, as the solid line shown in FIG. 3, a light b4 of the wavelength other than the wavelength b1 penetrates the transmission-type reflecting plate 25 and reaches the solar cell 22.

On the other hand, the coating layer 26 is provided with a shaft insertion hole 26*a* communicating with the shaft insertion hole 28*a* and is, as shown in FIGS. 2 and 3, attached to the hologram layer 28 at the hands side via an adhering layer 33. The coating layer 26 is formed entirely from a transparent or translucent material of a synthetic resin such as polycarbonate, acrylate, polyester, or the like. The light resistance and moisture resistance of the hologram layer 28 are increased and also the incorporation of the transmission-type reflecting plate 25 into the display mechanism 24 can be simply performed. An auxiliary display unit 34 (shown in FIG. 1) including characters, patterns, marks, and the like, which constitutes a display unit other than the hand display unit 17 is formed on the hand side of the coating layer.

In addition, the wheels & pinions 20, 21 are inserted into each shaft insertion hole for the coating layer 26, hologram layer 28, solar cell 22, and circuit substrate 23.

In such a display unit structure for an electronic device, when the incident light a from the light source 31 penetrates the coating layer 26 and enters into the hologram layer 28, the light b1 having a predetermined wavelength is reflected on the virtual mirror plane 29. At this time, if the observer 32 arranges the line of sight on the path of the light b1 having a predetermined wavelength, the light b1 having the predetermined wavelength reaches the observer 32 and is viewed as the light of a specific color.

Here, when the observer 32 alters a sight point or the position of a watch, thereby to disarrange the line of sight on the path of the light b1, the light b1 never reaches the observer 32.

Accordingly, the solar cell 22 can be shielded so that it is not viewed from the hands side and also a desired color tone for the display unit (transmission-type reflecting plate 25) can be obtained, whereby the degree of freedom in designing the appearance can be increased.

On the other hand, the light b4 of a wavelength other than the wavelength b1 penetrates the hologram layer 28 and base layer 27, reaches the solar cell 22, and is utilized for power generation of the solar cell 22. The generated power is supplied to the movement 15 via a condenser (not shown) to drive the movement 15 and thereby to rotate the wheels & pinions 20, 21.

Therefore, the incident light which enters the hologram layer 28 never scatters in all directions to result in an increase in the light entering the hologram layer 28, whereby the light utilization efficiency can be promoted.

In addition, the observer 32 arranges the line of sight in the direction (the path of lights b1) which allows the hand display unit 17 to be viewed so that the time can be read.

Next, a second embodiment will be illustrated with reference to the drawing.

Figure 4:
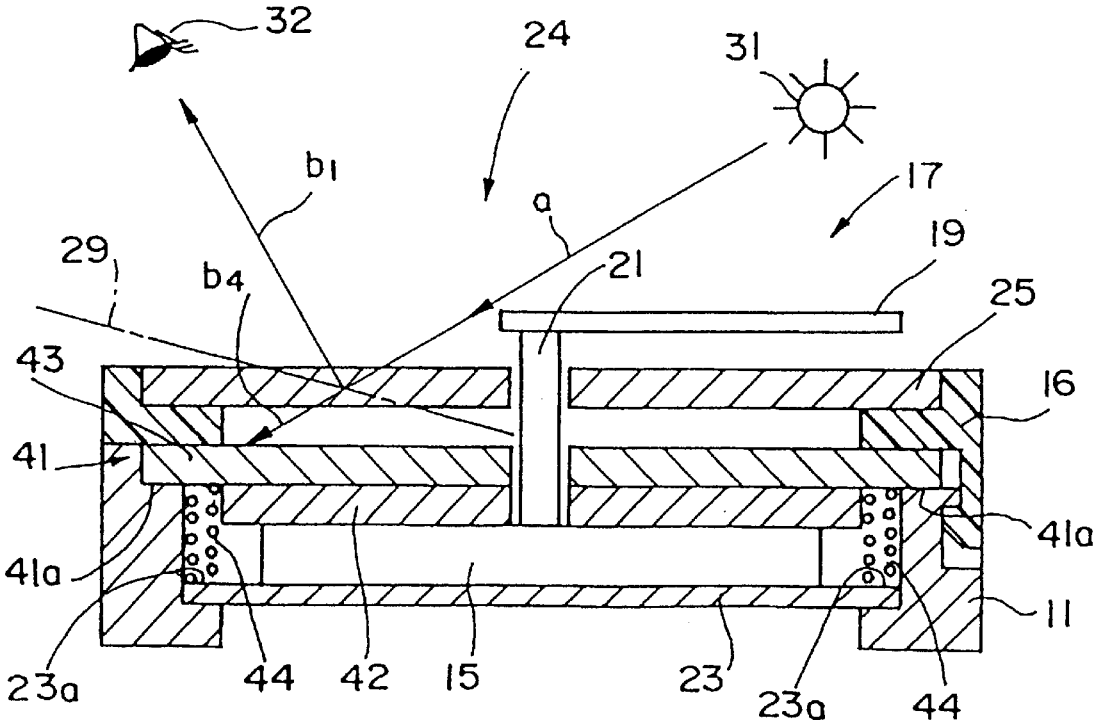
FIG. 4 is a vertical sectional view of a main portion of an internal mechanism of a wrist watch provided with a display unit structure for the electronic device corresponding to a second embodiment, in which the internal structure of the movement and the like are omitted.

FIG. 4 is a vertical sectional view of a main portion of the internal mechanism of a wrist watch provided with a display unit structure for an electronic device corresponding to a second embodiment, in which the same or equivalent materials as those in FIG. 1 are represented by the same symbols (excluding the solar cell). Therefore detailed descriptions are omitted and, also, in FIG. 4, the internal structure of the movement and the like are omitted.

In FIG. 4, a solar cell represented by the symbol 41 is similar to the solar cell 22 in the first embodiment and includes a metal plate 42 formed of a SUS material or the like and of an amorphous silicon layer 43 formed on the metal plate 42 by vapor deposition or the like. The solar cell 41 is supported in a case band/case body 11 via a casing ring/casing frame 16. An electrode 41*a* connecting with a terminal 23*a* of a circuit substrate 23 via a compressed coil spring 44 is formed in the solar cell 41.

In such a display unit structure for an electronic device, when the incident light a from the light source 31 enters a transmission-type reflecting plate 25 (hologram layer), a light b1 is reflected on the virtual mirror plane 29 and a light b4 of the wavelength other than a wavelength b1 penetrates the transmission-type reflecting plate 25 and reaches the solar cell 41. Therefore, a degree of freedom in designing the appearance can be increased in the same manner as in the first embodiment.

Next, a third embodiment will be described with reference to the drawing.

Figure 5:
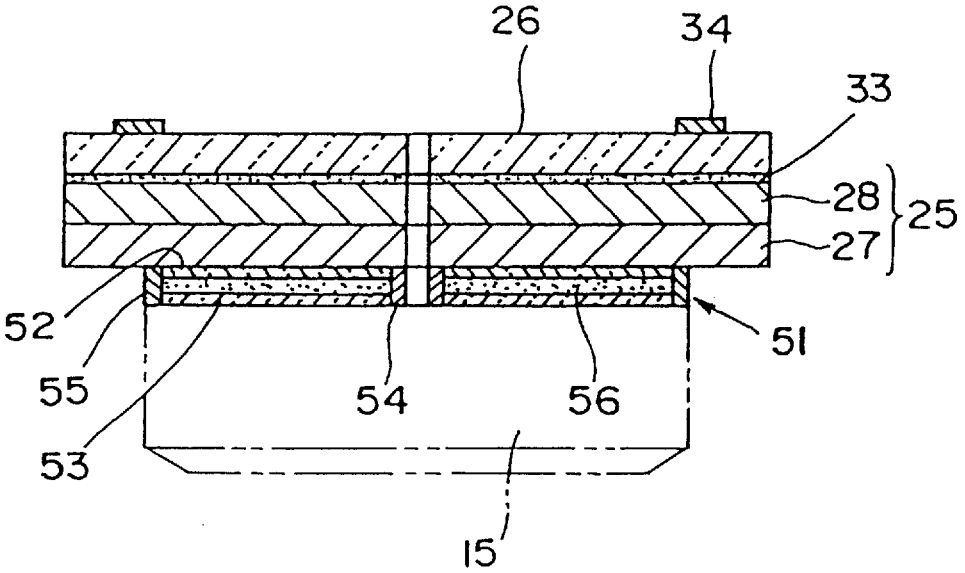
FIG. 5 is a vertical sectional view showing the case where a watch with electro luminescence illumination is incorporated in a display unit structure for the electronic device corresponding to a third embodiment, in which the internal structure of the movement and the like are omitted.

FIG. 5 is a vertical sectional view showing the case where a watch with electro luminescence illumination incorporated in a display unit structure for an electronic device corresponding to a third embodiment, in which the same or equivalent materials as those in FIGS. 1 and 2 are represented by the same symbols, so that detailed descriptions are omitted. Also, in FIG. 5, the internal structure of the movement and the like are omitted.

In FIG. 5, the symbol 51 represents an electro luminescence panel. Wheels & pinions 20, 21 (shown in FIG. 1) are inserted into the center of the electro luminescence panel 51 which is disposed between a movement 15 and a transmission-type reflecting plate 25. The electro luminescence panel 51 includes upper and lower circular transparent sections 52, 53 made of a synthetic resin, which face each other at a specific interval in a vertical direction (the axial direction of the wheels & pinions 20, 21), inner and outer cylindrical seal materials 54, 55, which extend inner and outer peripheries of the transparent materials 52, 53 respectively, and a fluorescent body 56 of zinc sulfate or the like which is imposed between both of the sealing materials 54, 55 and both of the transparent sections 52, 53. The electro luminescence panel 51 emits light by the application of an a.c. voltage, whereby a hand display unit 17 is illuminated.

In such a display unit structure for an electronic device, the electro luminescence panel 51 can be shielded so that it is not viewed from the hands side. Also a desired color tone for the display unit (transmission-type reflecting plate 25) can be obtained, whereby the degree of freedom in designing the appearance can be increased.

Next, a fourth embodiment will be described with reference to the drawing.

Figure 6:
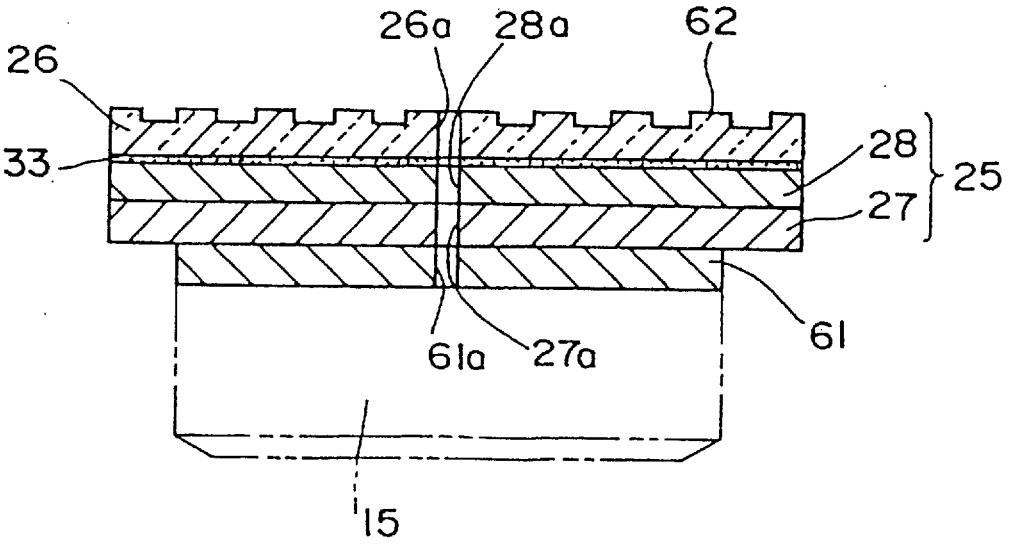
FIG. 6 is a vertical sectional view showing the case where an analogously indicative watch is incorporated in a display unit structure for the electronic device corresponding to a fourth embodiment, in which the internal structure of the movement and the like are omitted.

FIG. 6 is a vertical sectional view showing the case where an analogously indicating watch is incorporated with a display unit structure for an electronic device corresponding to a fourth embodiment, in which the same or equivalent materials as those in FIGS. 1 and 2 are represented by the same symbols, so that detailed descriptions are omitted. Also, in FIG. 6, the internal structure of the movement and the like are omitted.

In FIG. 6, the symbol 61 represents a metal plate including a shaft insertion hole 61*a* into which wheels & pinions 20, 21 are inserted. The metal plate 61 is disposed between a movement 15 and a transmission-type reflecting plate 25.

Also, different from the embodiments shown in FIG. 1 and 5 an auxiliary display unit 62 including characters, patterns, marks, and the like is integrally formed with and over the entire surface of a coating layer 26.

In such a display unit structure for an electronic device, the internal structure of a watch can be shielded so that it is not viewed from the hands side. Also, a desired color tone for the display unit (transmission-type reflecting plate 25) can be obtained, whereby the degree of freedom in designing the appearance can be increased.

Next, a fifth embodiment will be described with reference to the drawing.

Figure 7:
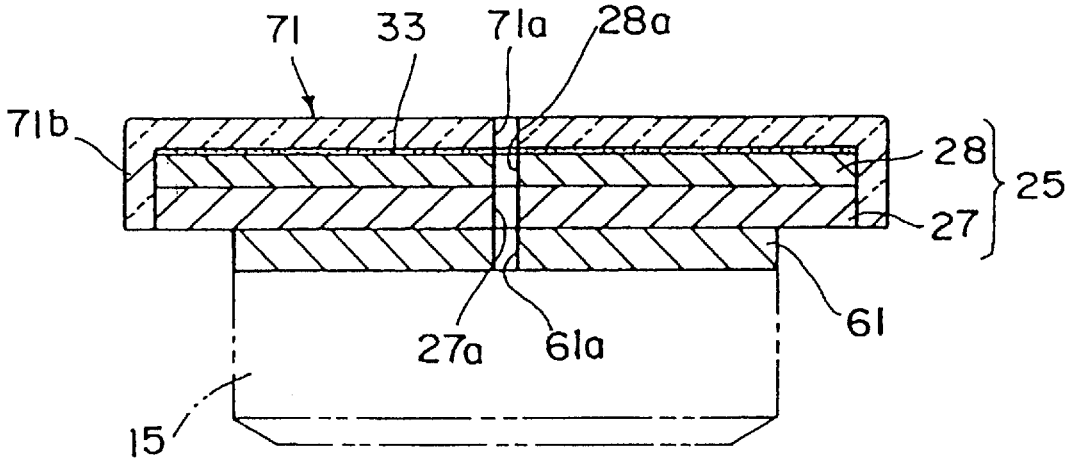
FIG. 7 is a vertical sectional view showing a display unit structure for the electronic device corresponding to a fifth embodiment, in which the internal structure of the movement and the like are omitted.

FIG. 7 is a vertical sectional view showing a display unit structure for an electronic device corresponding to a fifth embodiment, in which the same or equivalent materials as those in FIG. 6 are represented by the same symbols, so that the detailed descriptions are omitted.

In FIG. 7, the symbol 71 represents a coating layer which constitutes a part of a display mechanism 24. The coating layer 71 is provided with a shaft insertion hole 71*a* communicating with a shaft insertion hole 28*a* and is attached to a hologram layer 28 at the hands side via an adhering layer 33. The coating layer 71 is formed of the same transparent material as the coating layer 26 in the first embodiment or of a translucent material. A circular wall 71*b* covering the outer periphery of a transparent reflecting plate 25 is integrated with the outer periphery of the coating layer 71 at the side opposite to the hands (below in FIG. 7). The light resistance and moisture resistance of a hologram layer 28 are further increased.

In such a display unit structure for an electronic device, a metal plate 61 and the like can be shielded so that it is not viewed from the outside. Also, a desired color tone for the display unit (transmission-type reflecting plate 25) can be obtained, whereby the degree of freedom in designing the appearance can be increased.

Figure 8:
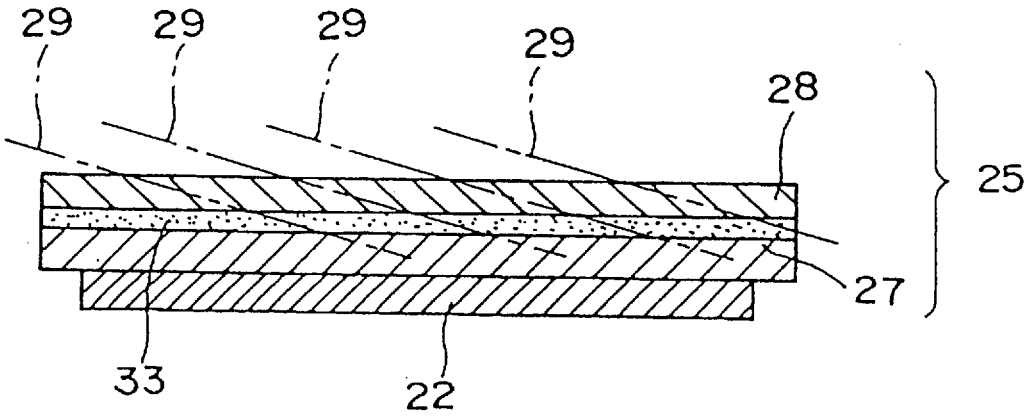
FIG. 8 is a vertical sectional view showing a display unit structure for the electronic device corresponding to a sixth embodiment, in which the internal structure of the movement and the like are omitted.
Figure 9:
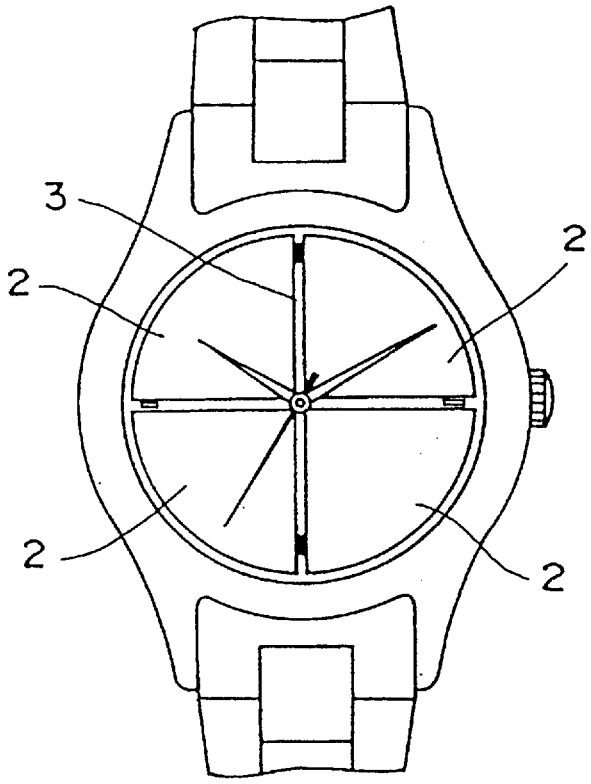
FIG. 9 is a top plan view of a main portion of a wrist watch provided with a conventional display unit structure for an electronic device.
Figure 10:
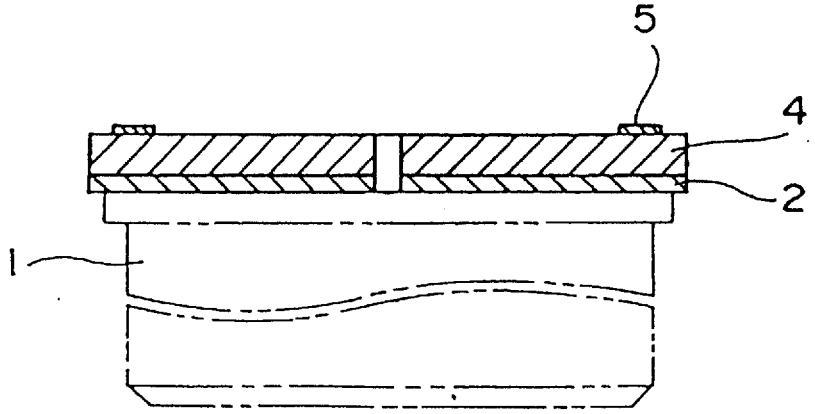
FIG. 10 is a vertical sectional view of a conventional display unit structure for an electronic device.

Incidentally, though the case where the virtual mirror plane 29 is single is shown in each embodiment, a plurality of virtual mirror planes is provided in general as shown in FIG. 8 (sixth embodiment). When the observer 32 arranges the line of sight on the path of the light b1 having a predetermined wavelength reflected on the virtual mirror plane 29, the light b1 having a predetermined wavelength can be viewed as a light of a specific color.

INDUSTRIAL APPLICABILITY OF THE INVENTION

As is clear from the above illustrations, the display unit structure for an electronic device corresponding to the present invention can be used for display unit structures for various electronic devices such as electronic watches, electronic calculators, portable radios, and the like.

What is claimed is:

1. A display unit structure for an electronic device, comprising:

a solar cell, and a display unit including a transparent base layer disposed on the solar cell, and a hologram layer laminated on the base layer and having a virtual mirror plane for reflecting a light with a predetermined wavelength, said virtual mirror plane of the hologram layer being inclined with respect to front and back surfaces of the hologram layer so that the light with the predetermined wavelength is reflected by the hologram layer and light other than the predetermined wavelength is transmitted to the solar cell through the hologram layer.

2. The display unit structure for an electronic device according to claim 1, wherein a coating layer made of a synthetic resin is disposed on the front surface of the hologram layer.

3. The display unit structure for an electronic device according to claim 1, wherein the coating layer is made of a synthetic resin selected from a group consisting of a polycarbonate resin, acryl resin, and polyester resin.

4. The display unit structure for an electronic device according to claim 1, wherein patterns, marks, and characters are formed on the coating layer.

5. The display unit structure for an electronic device according to claim 1, wherein the coating layer is made of a colored translucent material.

6. The display unit structure for an electronic device according to claim 1, further comprising a movement, on which said solar cell is disposed, said movement having a step motor and shafts for hands, said solar cell and display unit having shaft insertion holes for allowing the shafts to pass therethrough.

7. A display unit structure for an electronic device, comprising:

a movement, an electro luminescent element formed at one side of the movement, and a display unit including a transparent base layer disposed on the electro luminescent element, and a hologram layer laminated on the base layer and having a virtual mirror plane for reflecting a light with a predetermined wavelength, said virtual mirror plane of the hologram layer being inclined with respect to front and back surfaces of the hologram layer so that the light with the predetermined wavelength is reflected by the hologram layer and light other than the predetermined wavelength is transmitted through the hologram layer.

8. The display unit structure for an electronic device according to claim 7, wherein said movement includes a step motor and shafts for hands, said electro luminescent element and display unit having shaft insertion holes for allowing the shafts to pass therethrough.

9. The display unit structure for an electronic device according to claim 7, wherein the display unit is a hand display unit.

10. The display unit structure for an electronic device according to claim 7, wherein a side wall covering a side end surface of the hologram layer is installed at an edge portion of the coating layer.

* * * * *